United States Patent [19]

Kistner et al.

[11] 4,046,043

[45] Sept. 6, 1977

[54] DEVICE FOR CONVEYING AND CUTTING A PILE OF SHEETS

[75] Inventors: Hermann Kistner, Tamm; Gunthart Lehmann, Heubach, Lautern, both of Germany

[73] Assignee: Maschinenbau Oppenweiler GmbH, Oppenweiler, Germany

[21] Appl. No.: 672,435

[22] Filed: Mar. 31, 1976

[30] Foreign Application Priority Data

Apr. 4, 1975 Germany ..... 2514837

[51] Int. Cl.[2] ..... B26D 7/06

[52] U.S. Cl. ..... 83/425.4; 83/430; 83/435.2; 83/925 A

[58] Field of Search ..... 83/430, 435, 925 A, 83/435.2, 425.4

[56] References Cited

U.S. PATENT DOCUMENTS

| | | | |
|---|---|---|---|
| 1,261,368 | 4/1918 | Dion | 83/430 |
| 2,131,851 | 10/1938 | Anstice | 83/435 X |
| 3,165,951 | 1/1965 | Lindquist | 83/435 X |
| 3,213,733 | 10/1965 | Glendening | 83/925 A |

*Primary Examiner*—Willie G. Abercrombie
*Attorney, Agent, or Firm*—Wigman & Cohen

[57] ABSTRACT

A device for conveying and cutting a pile of sheets with a disk-knife having an associated conveyor for continuously supplying the pile of sheets to the disk-knife, being of relatively simple construction and guaranteeing a satisfactory smooth cut acceptable for a visible surface, through a specially designed clamping member.

23 Claims, 13 Drawing Figures

Fig. 5.
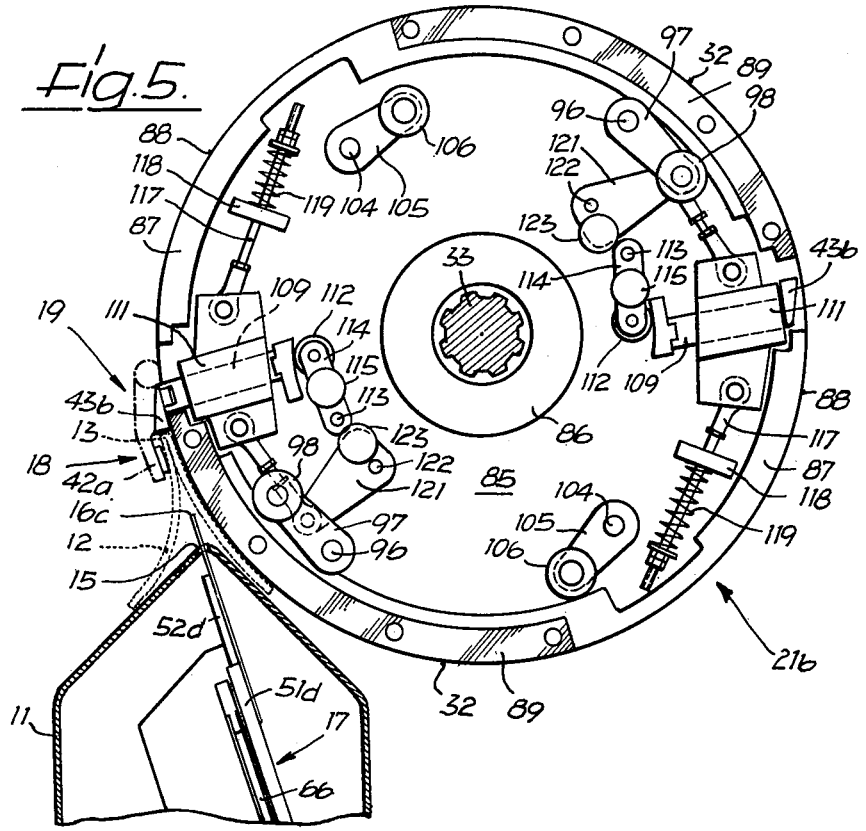
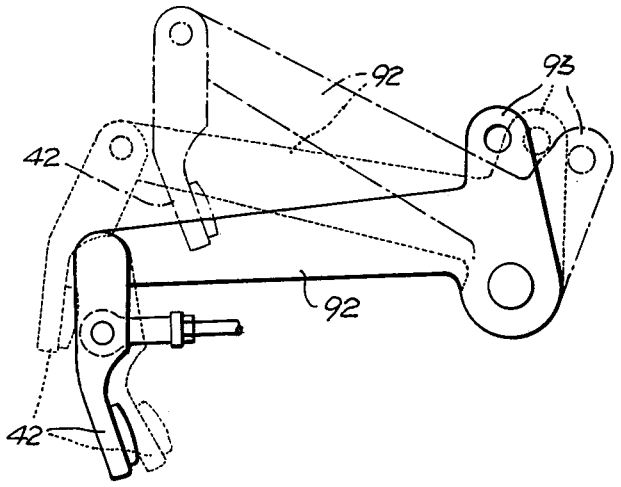
Fig. 6.

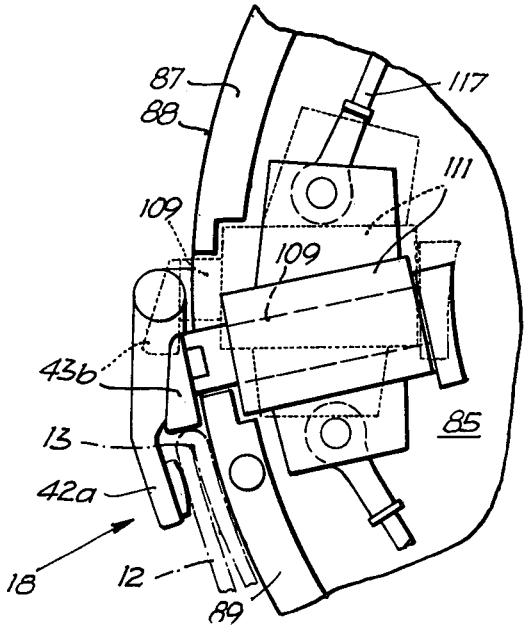
Fig. 7.
Fig. 10.
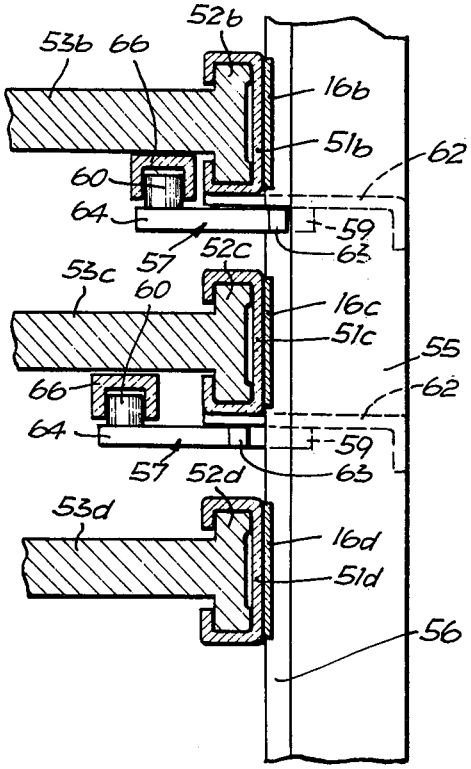
Fig. 11.
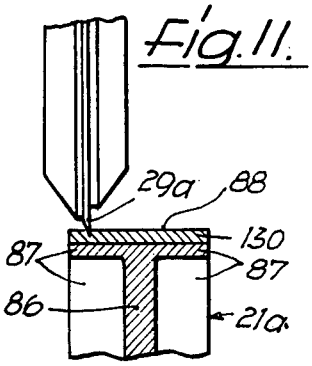

DEVICE FOR CONVEYING AND CUTTING A PILE OF SHEETS

BACKGROUND OF THE INVENTION

1. Field of the Invention

The invention pertains to a device for conveying and cutting a pile of sheets by means of a disk-knife or revolving blade, with which is associated a conveyor feeding the pile of sheets to the disk-knife while holding them between two surfaces facing one another, at least one of said surfaces being the surface of an endless belt.

2. Description of the Prior Art

In what follows, the term "pile of sheets" shall mean any pile (or set) of sheets or folios which lie on top of each other, for example a book, a sheet folded several times, a booklet, a signature, etc.

The term "booklet" shall mean a pile of sheets, consisting of sheets lying on top of each other and all of which are folded around a common fold which forms the "back" of the booklet. The folios or sheets forming the booklet can be stapled or glued at the back. However, they can also be joined loosely to each other. Such a booklet may be called also a "signature".

The term "cutting a pile of sheets" shall include the so-called "trimming", in which the edges of a pile of sheets, for example the edges of a booklet, are cut, because even when only its edges are trimmed, the pile of sheets has to be cut through.

The term "endless belt" is to be understood as generic term for endless belts, strips, chains, ropes, strings, cords or the like.

Prior art shows, for example, at the delivery end of folding machines, the use of disk-knives for trimming the edges of booklets or for cutting the booklets in the middle. However, in these known devices each disk-knife has a cylindrical counter knife associated with it. The disk-knife for cutting through the booklet has a circumferential cutting edge whose cross-section is an acute angle and whose side next to the counter knife is plane. The counter knife is formed by the circumferential corner, virtually right-angled in cross-section, of a cylinder. The latter and a second cylinder, whose axis is concentric with that of the disk-knife, form a clamping-slit for the booklet. With increasing thickness of the booklet, the point at which the disk-knife starts its cut moves farther and farther away from the clamping slit in a direction opposite to the direction in which the booklet advances, so that the disk-knife must penetrate into the booklet at a point at which the booklet is not supported by the counter knife nor gripped in the clamping slit. The consequence is, that, at the point of penetration of the disk-knife, the individual sheets of the booklet are not secured against displacement relative to each other. Thus, as the disk-knife penetrates into the booklet, the position of the sheets is distorted and the cut becomes necessarily more and more irregular with increasing thickness of the booklet.

With folding machines, a somewhat irregular cut has but little significance, because the booklets are usually units or sections of books (signatures), which after the binding process has been completed, are again trimmed by means of a guillotine knife.

Devices of the type just described, have been disclosed in U.S. Pat. Nos. 1,704,454 and 1,835,685. These references take the knowledge described above as a point of departure, namely, that a pile of sheets cannot be cut cleanly with a disk-knife, because the disk-knife displaces the sheets relative to each other, and that, for this reason, the trimmed back of the book does not extend at a right angle to the sides of the book. (U.S. Pat. No. 1,835,685 p. 2, lines 68 to 73). Therefore, in the just mentioned reference, it is proposed to use two disk-knives, arranged on opposite sides of the pile of sheets in such a manner, that the plane sides of their cutting edges point in the same direction and lie in the common cutting-plane; furthermore, each disk-knife is arranged to cut into the pile of sheets somewhat beyond the half-way line. It is apparent, that with this known device one cannot produce a cut suitable for a visible surface, because the aforementioned device does not furnish a scissor-cut and the two cutting edges, mounted some distance apart from each other, without a counter knife, merely penetrate into the pile of sheets. For this reason, the known devices are proposed only for the trimming of backs of books, which are glued later on. For this purpose, a rough cut is even desirable for a better penetration of the glue. In addition, it would be pointless to produce a surface which appears clean-cut to the eye, because the backs of the books are grooved in any event to make it easier to glue on the backbone of the book, as has been brought out in the above-mentioned references.

It seems that, for the above-mentioned reasons, the devices disclosed in the two cited U.S. patents have not proven themselves as means for cutting the backs of books. For that purpose, according to West German OS-publication No. 2,416,461, milling cutters or saws are used with a peripheral speed several times greater than the forward speed of the pile of sheets. The use of milling cutters and saws has the advantage that it avoids the high cutting pressure when the paper is sheared off which results from the tearing of the paper fiber at the cutting point. This tearing of the paper fibers results in a rough cut which is desirable for the trimming of the back of a book to be glued subsequently. In any case, none of the cited processes makes it possible to obtain a cut with a circular cutter leaving a smooth appearing edge surface on a pile of sheets, for example, on a booklet or a book.

For this reason, guillotine knives have been used exclusively until now for trimming piles of sheets, such as books, booklets, etc., whenever a smooth looking cutting surface is to be obtained. Guillotine knives furnish a very smooth, clean cut, because, in this instance, a pressure bar adjacent to the knife holds the sheets, and presses them together so that they cannot shift before and while the knife penetrates into the pile. However the guillotine cutting devices have the disadvantage that, during the cutting process, the pile of sheets to be cut must remain stationary relative to the cutting device. But this requires that the pile of sheets is brought to and removed from the cutting device in step-like fashion, which diminishes the capacity (output) of such a cutting device. To avoid this loss of capacity, decades of development of the guillotine knife have led to an elaborate cutting device disclosed in U.S. Pat. No. 3,552,246 in which the step-wise transporting of books has been eliminated by a mechanism, in which the entire guillotine cutter assembly oscillates back and forth in the direction of travel of the pile of sheets. This shows that industry did not hesitate to utilize highly advanced technical solutions to eliminate the disadvantage of intermittent transport of the pile of sheets.

It is the purpose of the present invention to obviate the aforementioned difficulties by providing a device for cutting a pile of sheets with a disk-knife, wherein the pile of sheets can be supplied to the disk-knife in uninterrupted, continuous flow, and which, with a relatively simple construction, will guarantee a satisfactory smooth cut, acceptable for a visible surface.

SUMMARY OF THE INVENTION

The preferred embodiment of the present invention solves the problem inherent in cutting devices according to the field of the invention by providing a special conveyor for feeding the pile of sheets which conveyor constitutes together with a disk-knife a cutting device. This conveyor includes a first conveyor element having a convex cylindrical circumferential surface and a second conveyor element forming an endless belt. This endless belt is deflected by deflecting means, e.g., pulleys or rolls, so that a part of the belt is deflected by a segment of the cylindrical surface of the first conveyor element. First and second conveyor surfaces are supported by this segment and the mentioned part of the endless belt respectively and define a clamping slit or gap between them for clamping the pile of sheets and for conveying it through this gap. The disk-knife is supported such that its cutting edge overlaps with the first conveyor surface forming in this way the special cutting device. The term "cylindrical" is used in the general geometrical sense and includes the term "circular cylindrical" only as a special form.

Because the convex cylindrical circumferential surface of the first conveyor element deflects the endless belt at one section of its circumferential surface, a clamping gap is created in the space between the two conveyor surfaces, into which gap the pile of sheets can be fed.

Depending upon the selected tension of the endless belt, it is possible to arbitrarily adjust the pressure with which the two conveyor surfaces are pressed against the pile of sheets. This can be achieved, for example, by selecting a elastomeric endless belt having the desired elastic properties. One of the preferred embodiments, however, employs a non-extendable, endless belt, e.g., a toothed belt reinforced with steel ropes. The resilient fit to a clamping device thereby achieved is effected by resiliently supporting a pulley, such as a spring-loaded idler pulley, so that the desired pressure for pressing the two conveyor surfaces together is obtained by selection of the resilient support of the spring-loaded idler pulley. The resulting conveyor is of a surprising simplicity, because it is, e.g., merely possible to have the first conveyor element shaped as a body having a circular cylindrical circumferential surface, e.g., as a roller, cylinder, or wheel, and an endless belt guided along one of its segments by means of at least one deflecting pulley.

Because the cutting edge of the disk-knife overlaps with the first conveyor surface which forms a cutting device with the disk-knife, the pile of sheets is cut through by a clean scissor-like cut. Furthermore, also the endless belt can readily be guided such that the second conveyor surface extends up to the plane lateral surface of the disk-knife so that during the cutting operation the pile of sheets is firmly compressed in the clamping gap directly next to the cut. Thereby, neither the pile of sheets as a whole, nor individual sheets lying on top of each other are displaced by the cutting pressure during the cutting operation, which fact is of basic significance for a clean cut. Booklets that are cut through at right angles to the back of the booklet using familiar devices, have unclean sections of the cut near the back, because they are clamped between two plane clamping surfaces during the cutting operation, and thereby the sheets are not properly pressed together within the curved back of the booklet. In contrast thereto, the invention has the particular advantage that the endless belt is substantially joined closely to the curved back of the booklet. The sheets are thereby firmly pressed together within the booklet back, so that a conspicuously clean cut results even for thick booklets.

The edge of the first conveyor element which is closest to the disk-knife, can be constructed as a counter knife and may overlap with the cutting edge of the disk-knife. Another possibility would be to cover the circumferential surface of th first conveyor element with a layer that can be cut, into which the cutting edge of the disk-knife engages, so that it also overlaps with the first conveyor surface, namely, the surface of that layer, and said layer then forms the counter knife. A particular advantage of this arrangement consists in the fact that the counter knife formed by the cuttable layer supports the pile of sheets on both sides of the cutting plane such that pinching a sheet between both knives is avoided with certainty. It is indeed known in the case of sophisticated guillotine knife, to construct the counter knife as a cuttable layer. But since the cutting edge of the guillotine knives forms an angle with its cutting direction, in order to gradually penetrate the pile of sheets and to perform a drawing cut, it is necessary to pivot the knife shortly before completing its cutting stroke, so that it strikes the cuttable layer parallel to the same. Furthermore, use of the cuttable layer has the disadvantage in the case of guillotine knives that the cuttings remain on the cuttable layer, and may obstruct the introduction of a new pile that is to be cut. All of these difficulties do not apply to the subject of the present invention, because the drawing cut here is simply achieved by driving the disk-knife at a circumferential speed which is somewhat different from the linear velocity of advance of the pile of sheets, e.g., is somewhat greater, so that upon application of a cuttable layer as counter-knife, it is not necessary to make particular arrangements. Furthermore, movement of the two conveyor surfaces automatically directs the cuttings away, so that they cannot cause difficulties.

In the case of one advantageous embodiment of the invention, the endless belt is directed around at least three deflecting pulleys so that the first conveyor element is located beyond the space spanned by the endless belt. This has the effect that both ends of the clamping gap end in an area not encompassed by the endless belt. Accordingly, the pile of sheets can be transported parallel to the same plane perpendicular to the axis of revolution of the conveyor surfaces toward and away from the clamping gap as said pile is being moved within the clamping gap, thus resulting in a simplified construction of the total device.

A further advantage of the invention resides in being readily able to arrange two or more cutting devices next to each other in parallel. This results in a very simple construction of a device for cutting a pile of sheets, by means of which several cuts can be made simultaneously. For example, in this way a booklet can be trimmed at the same time along its top and bottom edges. Furthermore, one booklet can be divided into several booklets by means of corresponding cuts carried out by additional cutting devices.

In order to ensure proper introduction of a pile of sheets into the clamping gap, one advantageous embodiment of the invention provides for at least one pressing means or gripping jaw for feeding the pile of sheets into the clamping slit, said jaw supported to be moveable between a release and a gripping position. In the latter position, said jaw can be moved together with the first conveyor surface of the clamping device in order to clamp the leading edge of the pile of sheets for a clamping period of time against the first conveyor surface, the embodiment also provides a drive means for the gripping jaw which moves the same from the release position into the gripping position and back again depending upon the position of rotation of the first conveyor element. The gripping jaw then presses the pile of sheets fed by any known device, to the first conveyor surface prior to introduction to the clamping gap, thereby introducing the same into the clamping gap by revolving the first conveyor surface. In order to insure correct positioning of the pile of sheets thereby, a further advantageous embodiment of the invention may provide for a radially protruding stop on the first conveyor element above the first conveyor surface, for the leading edge of the pile of sheets.

Still further embodiments and advantages of the present invention will readily occur to one skilled in the art to which the invention pertains, upon reference to the following detailed description.

BRIEF DESCRIPTION OF THE DRAWINGS

The description refers to the accompanying drawings illustrating three embodiments, in which like reference characters refer to like parts throughout the several views and in which

FIG. 5 shows a view along the line V—V of FIG. 3 corresponding to FIG. 4, in which the outer face of the first conveyor element located to the right of FIG. 3 is shown with its cylindrical circumferential surface, whereby the support device with its cam plates has been omitted for simplicity, which device is located in front of said first conveyor element in the direction of sight;

FIG. 6 is a view similar to that in FIG. 4 of a gripping jaw in four different positions;

FIG. 7 is an enlarged partial section of FIG. 5, showing the stop in two different positions;

FIG. 10 is an enlarged sectional view on line X—X of FIG. 9;

FIG. 11 shows a detail of a second embodiment in a partial sectional view;

DETAILED DESCRIPTION OF A PREFERRED EMBODIMENT

Figure 1:
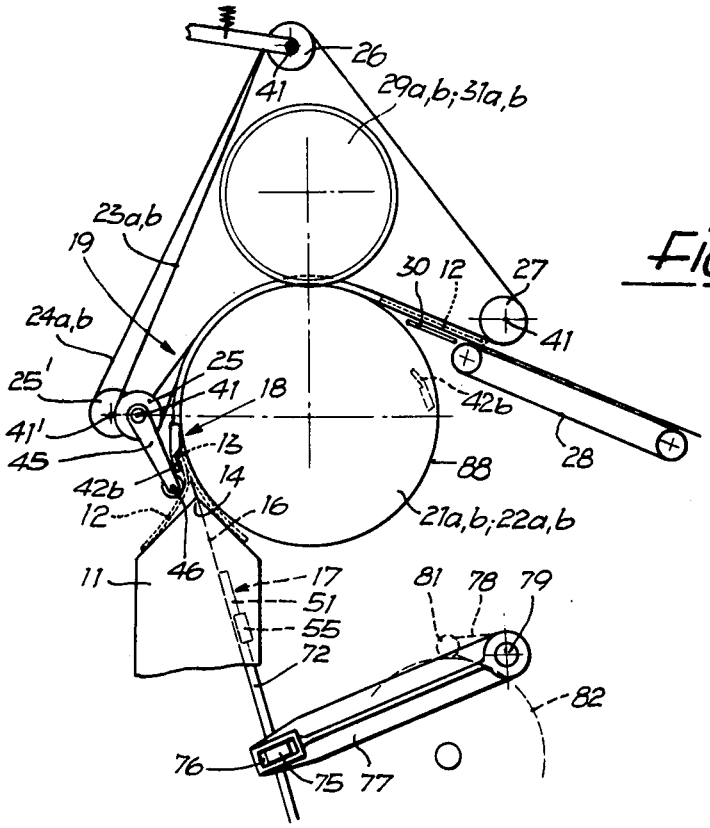
FIG. 1 is a simplified schematic side view of a first embodiment.
Figure 2:
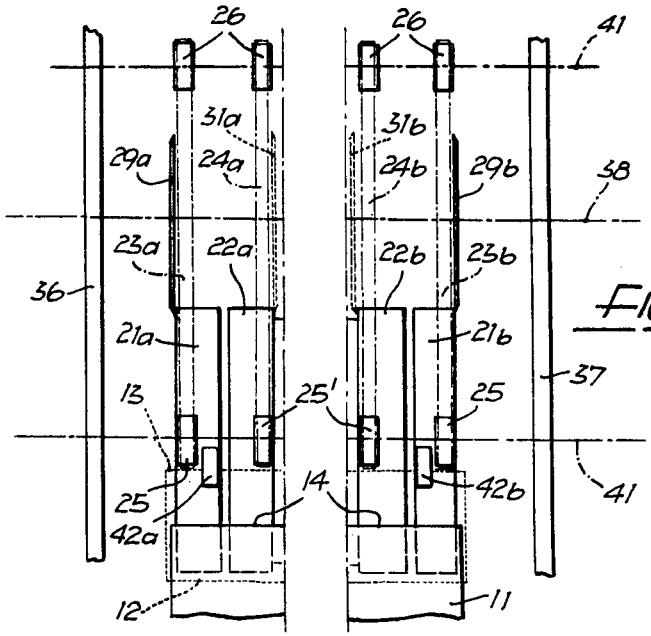
FIG. 2 is also a simplified, schematic front view as viewed from the left of FIG. 1.

Referring now to the drawings, the invention is described with reference to an apparatus for lifting and advancing a signature as illustrated in FIGS. 1-10.

GENERAL DESCRIPTION

As will be apparent from FIG. 1 of the drawings, the embodiment of the invention shown there comprises a wedge-shaped saddle 11 which in the illustrated embodiment forms part of the machine housing.

A stack of sheets in the form of a signature 12 which consists of superposed sheets which all together are nested so as to have a common fold line defining a signature back 13 is fed to this saddle 11. The signatures 12 are supplied to the saddle 11 in a known manner, for instance by means of the rotating collector chain described in Swiss Pat. No. 528 983 where the individual folded sheets are collected so that they form a common fold and are then supplied to the saddle 11 perpendicularly to the drawing plane of FIG. 1.

The shifting means used for this purpose are also known so that they need not be described in further detail.

There may be provided in a known manner stations where the signatures are, during this transport, checked as to their desired thickness and where they are stitched or glued together. The signature 12 is placed with the inner side of its back 13 on the saddle 11 such that the signature back 13 coincides with the vertex 14 of the saddle. This vertex 14 of the saddle 11 (FIGS. 4, 5 and 8) comprises a slot 15 for tongues 16*a, b, c* and *d* of an upwardly and downwardly movable lifting comb or jack referred to as a whole by 17 and illustrated in more detail in FIGS. 4, 8, 9 and 10. During their upward movement, the comb tongues 16 move below the inner side of the signature back 13 and thus lift the signature 12 from the saddle 11 to a transfer station or point 18 where the signature 12 is transferred by the lifting comb 17 to a conveyor designed as a clamping device referred to as a whole by 19 and having, in the illustrated embodiment, four pairs of co-operating conveyor or clamping elements 21*a*, 23*a*; 21*b*, 23*b*; 22*a*, 24*a* and 22*b*, 24*b* and two pressing means designed as two jaws 42*a* and 42*b* to be described in further detail in the following.

Each of the aforementioned pairs of clamping elements consists, on the one hand, of a first conveyor element or a wheel-shaped clamping element 21*a*, 21*b*, 22*a* or 22*b* and, on the other hand, of a clamping belt 23*a*, 23*b*, 24*a* and 24*b* respectively (FIGS. 1 and 3) each of the latter constituting a flexible, endless, elongated second conveyor element, in the preferred embodiment a toothed belt (also known as a timing belt).

Each of these clamping belts is so guided about three idle deflection pulleys or rollers 25 or 25', 26 and 27 that it contacts with its outer or conveyor surface a segment of about 90° of the circumference or conveyor surface of the associated clamping wheel, in order that the circumferential surface of the clamping wheel and the contacting surface of the clamping belt define a clamping gap. The uppermost deflection rollers 26 deflecting the sections of the clamping belts not in contact with the clamping wheels 21*a*, 21*b*, 22*a* and 22*b* are resiliently mounted tension rollers, so that each of the substantially non extensible clamping belts contacts said segment of the clamping wheel in a resilient manner and the clamping gap can thus adapt itself to the thickness of each signature. The deflection rollers 25' of the central clamping belts 24a and 24b are arranged at a greater distance from the associated clamping wheels 22a and 22b than the deflection rollers 25 of the clamping belts 23a and 23b so that the clamping gaps between the clamping elements 22 and 24 grip the signature later than the clamping gaps defined between the clamping elements 21 and 23. In order to lift the signature to the transfer point in as closed a form as possible, arms 45 are secured to mounting elements (not shown) of the deflection rollers 25, said arms carrying on their free ends rollers 46 bending the outer half of the signature towards the comb tongues 16.

When the signature has been lifted from the saddle 11 by the lifting comb 17 and advanced in the clamping gap along the clamping surfaces of the clamping wheels 21a, 21b, 22a and 22b, and after it has left the clamping gap, it is fed along a table 30 to a transport device 28 consisting of conveyor belts transporting the signature to further processing means.

Whilst the signature is guided through the clamping gap of the clamping elements, its upper and lower edges are trimmed by disk-knives or revolving cutter blades 29a and 29b and a middle strip cut out by further revolving cutter blades 31a and 31b. For this purpose, the edges of the clamping wheels adjacent to the revolving cutter blades have the form of cutting edges 32. In order that the clamping belts 23a, 23b, 24a and 24b can be accurately guided in the immediate cutting range of the revolving cutter blades 29a, 29b, 31a and 31b respectively, additional lateral guide rollers are provided which for the sake of clarity have not been illustrated in the drawing. These guide rollers prevent lateral deflection of the clamping belts in the cutting area.

All four clamping wheels 21a, 21b, 22a and 22b are mounted on a splined or key shaft 33, the outer clamping wheels 21a and 21b being connected for rotation with the shaft, but axially displaceable, the inner clamping wheels 22a and 22b being fixedly connected with the splined shaft 33, i.e. fixed for rotation therewith and axially undisplaceable. The splined shaft itself is axially displaceable and by means of a mechanism not shown in the drawing is mounted in an exactly adjustable manner in bearing sleeves 34 so as to be axially shiftable but not rotatable relative to these bearing sleeves. The bearing sleeves 34 in turn are rotatably mounted in bearing housings 35a and 35b. The bearing housing 35a is mounted to a mounting wall 36 which is itself shiftable in the direction of the longitudinal axis of the splined shaft 33 and can be fixedly secured in the machine housing. The bearing housing 35b is mounted to a stationary wall 37 of the machine housing. The clamping wheels 21a and 21b are so connected with these bearing housings 35a and 35b that they are rotatable, but cannot be shifted in the axial direction relative to these housings 35a and 35b.

The revolving cutter blades 29a, 29b, 31a and 31b are mounted in a similar manner on a splined shaft 38. This shaft is mounted in bearing sleeves 34 so as to be axially displaceable but not rotatable. The bearing sleeves 34 are mounted in bearing housings 39a and 39b so as to be rotatable but not axially displaceable. The outer revolving cutter blades 29a and 29b are so connected to these bearing housings 39a and 39b respectively that they are rotatable but cannot be axially displaced in respect to these housings 39a and 39b. The middle revolving blades 31a and 31b are fixedly arranged on the splined shaft 38. By means of an adjusting device not illustrated either, the axial position of the splined shaft 38 and thus of the middle revolving cutter blades 31 can be adjusted. The bearing housings 39a and 39b are so mounted in the mounting wall 36 and the stationary machine wall 37 respectively that they are vertically adjustable and fixable.

Like the clamping wheels 21a and 21b, the deflection rollers 25, 26 and 27 as well as 25' are mounted on axles 41 and 41' respectively, which axles are mounted to the walls 36 and 37 so as to be shiftable in the axial direction. The deflection rollers of the inner clamping belts 24a and 24b are carried by the corresponding axles 41 and 41' so as to be axially not shiftable, but rotatable relative to the axles. The deflection rollers of the outer clamping belts 23a and 23b are again connected with the adjacent walls 36 and 37 so as to be rotatable but axially not shiftable relative to these walls and are so seated on their axles 41 that they can be rotated and axially displaced relative to these axles.

Owing to the above-described mounting of the clamping elements 21, 22, 23 and 24, the arrangement can be adjusted to signatures 12 of different heights as measured along the signature back 13, in that the mounting wall 36 is simply shifted parallel to the longitudinal axis of the splined shafts 33 and 38, in accordance with the height of the signature, and set to the desired distance. This automatically results in a corresponding adjustment of the clamping elements 21 and 23 as well as of the associated outer revolving cutter blades 29. By shifting the splined shafts 33 and 38 as well as the axles 41 and 41' accordingly, the inner clamping elements 22 and 24 can then be adjusted to a desired position.

The transfer point 18 does not coincide with the beginning of the clamping gap but is arranged in front of, and displaced in a direction opposite to the direction of movement of the clamping surfaces at a distance from the clamping gap. To constitute an inlet of the clamping device at the transfer point, the above-mentioned clamping jaws 42a and 42b are provided which serve to clamp the back edge of the signature 12, when lifted by the lifting comb, to the clamping surface of the outer clamping wheels 21a and 21b. As can be seen from FIG. 3, these clamping jaws 42a and 42b are so arranged, that their paths of movement run beside and between the paths of movement of the clamping belts 23a and 23b so that the clamping jaws 42a and 42b and the clamping belts 23a and 23b do not interfere with one another. The clamping jaws 42a and 42b are mounted to the clamping wheels 21a and 21b respectively to be movable between a release and a clamping position so that they follow the movement of the clamping surface of their clamping wheel when they are in the clamping position.

Moreover, in order to accurately position the back 13 of a signature lited by the lifting comb 17 to the transfer point 18, stops or abutments 43a and 43b (FIGS. 3, 7) projecting radially beyond the clamping surface are mounted on the outer clamping wheels 21a and 21b for reciprocating movement between an operative position in which they project from the clamping surfaces of the clamping wheels 21a and 21b respectively and an inoperative position in which they lie below the clamping surfaces. These stops 43a and 43b are so arranged that their paths of movement coincide with the paths of movement of the clamping belts 23a and 23b. Owing to this arrangement, the stops 43*a* and 43*b* enter the clamping gaps between the outer clamping wheels 21, on the one hand, and the clamping belts 23, on the other, and momentarily open these gaps to receive the back margin of a signature 13 clamped by the clamping jaws 42 against the clamping wheels 21. As can be seen from FIG. 1, the deflection rollers 25' of the two inner clamping belts 24*a* and 24*b* adjacent to the transfer point 18 are located at a greater radial distance from the clamping wheels 22*a* and 22*b* respectively than the corresponding deflection rollers 25 of the clamping belts 23*a* and 23*b* from the clamping wheels 21*a* and 21*b* respectively. This radial distance is so chosen that the signature back can only be introduced into the clamping gap of the inner clamping elements 22 and 24 when the stops 43 have moved to their inoperative positions, and the signature has already been clamped in the clamping gaps of the clamping elements 21 and 23.

Special components of the embodiment according to the invention described generally above will be explained in more detail in the following.

THE LIFTING COMB

The saddle 11 defines a housing fixedly connected with the machine frame for mounting the lifting comb 17 illustrated in detail in FIGS. 4, 8, 9 and 10. Each comb tongue 16*a*, 16*b*, 16*c* and 16*d* is secured to the upper end of a comb-tongue holder 51*a*, 51*b*, 51*c* and 51*d* respectively which in section (FIG. 10) appears as a U-shaped rail and is guided for up-and-down movement on a guide edge 52*a*, 52*b*, 52*c* and 52*d* respectively of a T-shaped cross-section of a guide plate 53*a*, 53*b*, 53*c* and 53*d* respectively such that each comb tongue 16 can be moved from its lowermost position within the housing defined by the saddle 11 through the slot 15 to its uppermost position in which it has lifted the back edge of a signature 12 resting on the saddle 11 to the transfer point 18.

A hollow drive bar 55 (FIGS. 4, 9) of rectangular cross-section whose longitudinal axis runs parallel to the axis of the splined shaft 33 is provided as a drive means for all comb tongues 16*a*, 16*b*, 16*c* and 16*d*. The outer comb-tongue holders 51*a* and 51*d* are connected to this bar so as to be shiftable parallel to the longitudinal axis thereof whereas the inner comb-tongue holders 51*b* and 51*c* can be selectively coupled to the bar in such a manner that they can also be shifted in the longitudinal direction. For this purpose, the drive bar 55 comprises a ledge 56 at its lower edge facing the comb-tongue holders 51. A U-shaped engagement member not illustrated in the drawing is secured to each of the two outer comb-tongue holders 51*a* and 51*d*, said engagement member gripping the edge 56 from above and from below so that the comb-tongue holders 51*a* and 51*d* are so connected with the drive bar 55 that they are always shiftable in parallel with the ledge 56. In order to be able to releasably couple the two middle comb-tongue holders 51*b* and 51*c* with the drive bar 55, a latch 57 having the form of a substantially T-shaped lever is provided which comprises at the lower end of its web 58 an arm 59 which together with the web substantially defines an L, said arm being pivotable about a pivot 61 and being attached to an arm 62 provided on the associated comb-tongue holders 51*c* or 51*d* and defining an L together with the associated comb-tongue holder. The latch 57 is pivotable about this pivot 61 from the release position shown in FIG. 9 to the latching position shown in FIG. 4 and back again. In the latching position, one part 63 of the cross-piece of the T-shaped latch 57 engages the ledge 56 from above so that when the drive bar 55 is moved upwards, the coupled comb-tongue holder 51*b* or 51*c* is taken along. During its return movement, the drive bar 55 engages the arm 62 of the comb-tongue holder 51. In order that the latch 57 can be moved from the latching position to the release position and back again, the other part of its cross-piece comprises a guide pin 60 which extends into a rail 66 of U-shaped cross-section running parallel to the guide edge 52 and being guided for translatory motion by two parallel levers 70 of equal lengths which are pivotably mounted on the associated guide plates 53*b* and 53*c* respectively. Each of the two rails 66 carries on a lower extension a rotatably mounted roller 67*b* and 67*c* each of which rests on a cam 68 which extends in a plane parallel to the longitudinal axis of the drive bar 55.

The guide plates 53*a*, 53*b*, 53*c* and 53*d* are arranged parallel to each other and vertical to the axis of the drive bar 55 on two rods 69 running parallel to the longitudinal axis of the drive bar 55, with the guide plates 53*a*, *b* and *c* being shiftable vertically to their planes and the guide plate 53*d* being stationary. In order to be shiftable, each of the plates 53*a*, 53*b* and 53*c* is fixedly connected to two slider rods 71*a*, 71*b* and 71*c* respectively running parallel to the rods 69, said slider rods being connected to the mounting wall 36 to be shiftable therewith and axially adjustable relative thereto so that the distance of the guide plates 53*a*, 53*b* and 53*c* from the guide plates 53*d* and thus the distance of the comb-tongues 16*a*, 16*b* and 16*c* from the comb-tongue 16*d* can be adjusted as desired, i.e. adapted to the corresponding position of the clamping gaps of the clamping device. Since the connection of the rods 69 and 71 with the walls 36 and 37 including the intended adjustability of the slider rods 71*a*, *c* and *d* can be brought about in a known manner, these simple constructional measures need not be described here in further detail.

Figure 8:
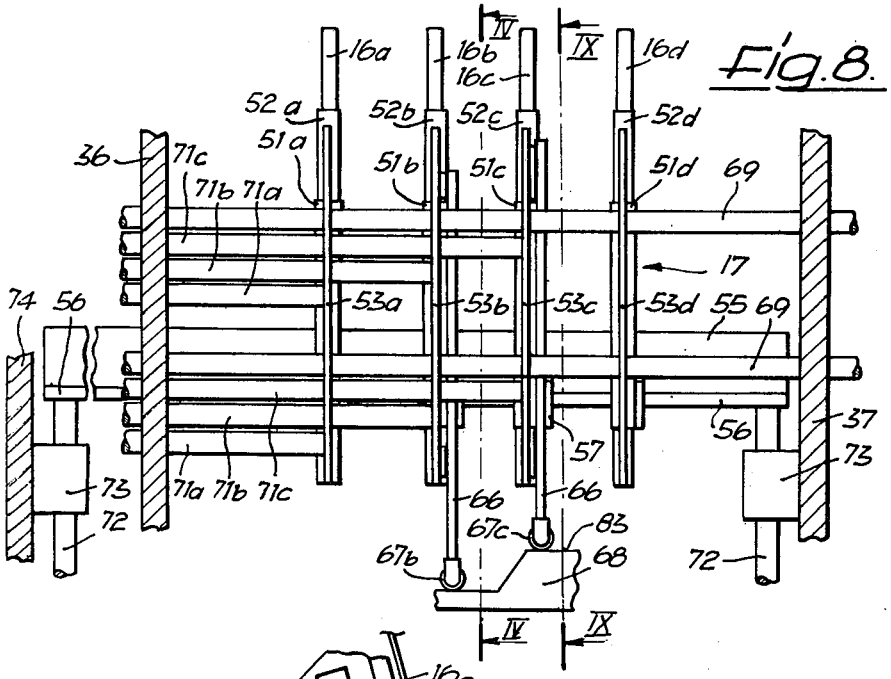
FIG. 8 is a partial sectional front view of a lifting comb.

The drive bar 55 comprises at its two ends guide rods 72 guided in guide means 73 of which the right-hand guide means 73 according to FIG. 8 is attached to the stationary wall 37 of the machine frame and the left-hand guide means according to FIG. 8 attached to a further stationary wall 74 of the machine frame. Below the guide means 73, each of the two guide rods 72 is provided with a pivotable sliding block 75 (FIGS. 1, 4) received in a recess 76 of one arm 77 of a two-armed lever 77, 78 which is pivotably mounted about a pin 79 and whose other arm 78 is urged by the pressure of a spring, not shown in the drawing, into contact with a cam disk 82, a roller 81 serving as a follower element. The drive of the cam disk 82 is derived from a central drive arrangement, not shown in the drawing, such that the drive means provided in the arrangement, which will be described later, cause the precisely coordinated movements as required for the functioning of the apparatus. In this connection, the cam disk 82 itself constitutes a second drive means, in addition to the drive bar 55.

Figure 9:
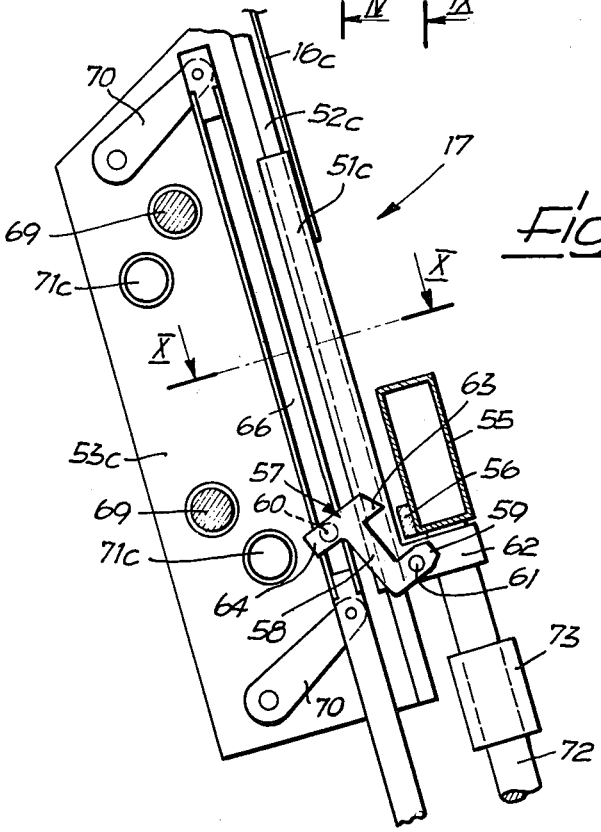
FIG. 9 is a side view on line IX—IX of FIG. 8 of a guide plate in a position in which the tongue of the comb is disengaged from the drive member.

As a result of the rotation of the cam disk 82, the arm 77 and thus the drive bar 55 together with the comb-tongue 16 coupled to it are moved up and down. When the apparatus is adjusted to a specific signature height, the mounting wall 36 and the guide plates 53 of the comb-tongue 16 are shifted as desired perpendicularly to their planes. If, during this operation, the roller 67*c* or the two rollers 67*c* and 67*b*, provided at the lower end of the guide rails 66, run onto an elevation 83 of the cam 68, the corresponding comb-tongue holders 15*c* on the one hand or 51*c* and 51*b* on the other are disconnected from the drive bar 55 as shown in FIG. 9. The elevation 83 is for this purpose arranged at such a point that when a comb-tongue 16*b* and/or 16*c* comes within the range of the clamping jaws 42*a* and 42*b* respectively the relevant comb-tongue is disconnected from the drive bar 55. To this end, it is advantageous to have the two rollers 67*b* and 67*c* run on different cams 68 displaced at right angles with respect to the plane of movement of the comb-tongues, which for the sake of clarity, has not been ilustrated in detail in the drawing.

THE WHEEL-SHAPED CLAMPING ELEMENTS

Figure 3:
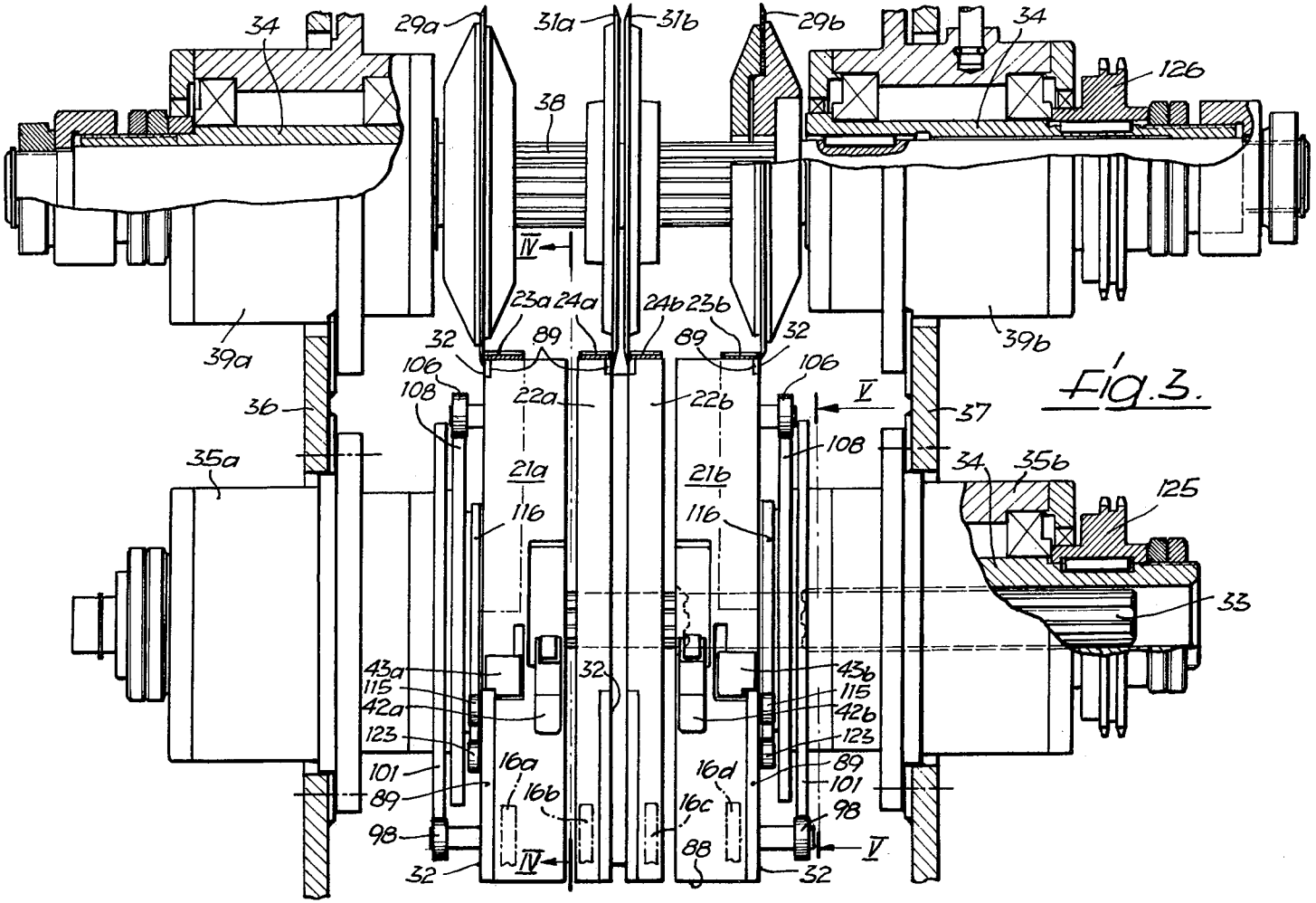
FIG. 3 is an enlarged front view of the top part of the device represented as a partial sectional view and more detailed than FIG. 2.
Figure 4:
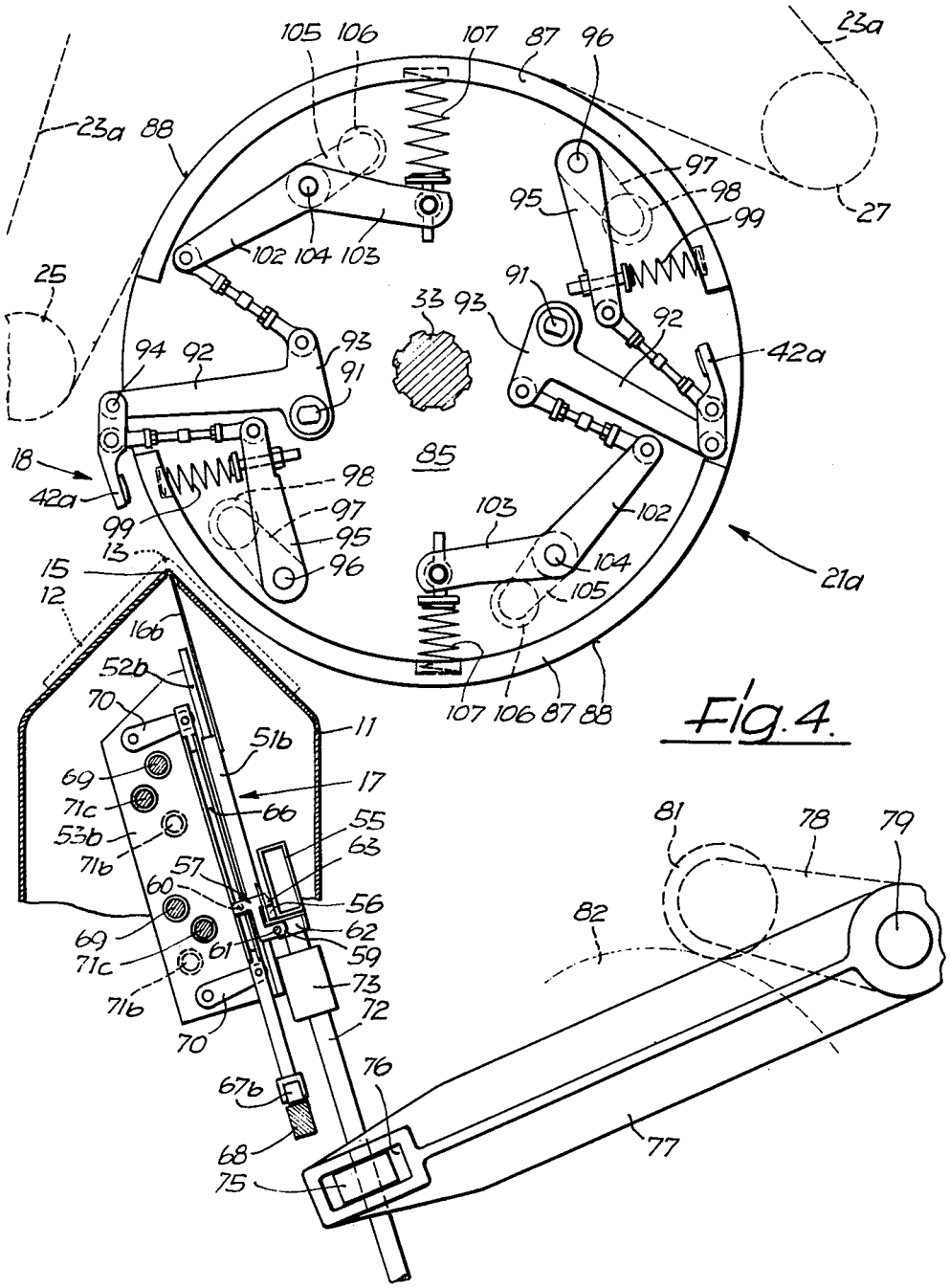
FIG. 4 is a sectional view on line IV—IV, the upper portion of which is taken from FIG. 3 and the lower portion of which is taken from FIG. 8, and in which the inner side of a first conveyor element with its cylindrical circumferential surface located to the left of FIG. 3, is shown in the upper portion.

The outer two clamping wheels 21*a* and 22*b* are arranged and constructed in an exactly mirror-image relationship to each other. For this reason, FIGS. 4 and 5 each show the right-hand sides of the clamping wheels 21*a* and 21*b* respectively, as seen in FIG. 3 from the right, FIG. 4 showing the inner side of the clamping wheel 21*a* facing the opposite clamping wheel and FIG. 5 showing the outer side of the clamping wheel 21*b* facing away from the opposite clamping wheel 21*a*. This results in a position of the parts, arranged on different sides of each clamping wheel as if when looking at one side of the clamping wheel, one could see, through the wheel, the parts of its other side as well. For better understanding of the arrangements on the two sides of a clamping wheel, it may thus be imagined that the two FIGS. 4 and 5 are placed one on top of the other.

In order to avoid repetitions, only clamping wheel 21*a* will be described in detail in the following. Its construction corresponds to the contruction of the clamping wheel 21*b* in a mirror-image relationship. FIG. 5 may be understood to be an illustration of the outer side (facing away from the clamping wheel 21*b*) of the clamping wheel 21*a* as seen in FIG. 3 from the right-hand side through its disk 85. This circular disk 85 has on its outer side a central hub 86 and on its outer circumference two cylindrical clamping shells 87 each of which forms a rim axially projecting from either side of the disk 85 and an outer circular-cylindrical clamping surface 88. Each of the two shells 87 has on its outer rim a cutter element 89 constituting the outer circular cutting edge 32 which co-operates with the revolving cutter blade 29*a* or, in the case of the clamping wheel 21*b*, with the revolving cutter blade 29*b*, to trim the upper and lower edges of the signature 12.

On the other, namely the inner side of the clamping wheel 21*a* (FIG. 4), two two-armed levers 92, 93 are each pivotably mounted about a pin 91. The one arm 92 of each of these levers carries at its outer free end the clamping jaw 42*a* which is pivotable about a pin 94 and is engaged by a lever 95 which is fixed to a shaft 96 rotatably mounted in the disk 85. That end of the shaft 96 which projects from the outer side (FIG. 5) of the disk 85 is fixedly connected with a second lever 97 which on its free end carries a roller 98 which serves as a follower element being urged by the force of a pressure spring 99 (FIG. 4) attached to the lever 95 to rest against a cam disk 101 (FIG. 3) secured to the bearing housing 35*a* and thus fixedly connected to the machine frame during operation. This cam serves to pivot the clamping jaw 42*a* contrary to the force of the spring 99 out of its clamping position, in which it clamps, under the force of spring 99, the back margin of a signature 12 to its release position, and then following the force of spring 99 to pivot the jaw 42*a* to its clamping position. Hence, the two cam disks 101 fixed to the bearing housing 35*a* and 35*b* represent, together with the springs 99, drive means for the clamping jaws 42*a* and 42*b*.

The second arm 93 of the two-armed lever 92, 93 is hingedly connected with one arm 102 of a second two-armed lever 102, 103 fixed on a shaft 104 which is mounted for rotation in the disk 85 and whose end projecting from the other side of the disk 85 is fixedly connected with a lever 105 carrying at its free end a roller 106 which serves as a follower element and is urged by a spring 107 engaged with the second arm 103 of the two-armed lever 102, 103 to rest against a second cam disk 108 fixed to the bearing housing 35*a*. The two-armed lever 92, 93 is so arranged that the free end of its arm 92 and the clamping jaw 42*a* project from the space between the two clamping shells 87, this position being shown on the left-hand side in FIG. 4. The lever 92, 93 is held in this position by the force of the pressure spring 107. The cam disk 108 causes the two-armed lever 102, 103 to be pivoted counterclockwise opposite to the force of the spring 107 when the clamping wheel 21*a* in FIG. 4 is rotated clockwise so that the clamping jaws 42*a* are pivoted to the retracted position within the path of rotation of the clamping surfaces 88 as shown on the right-hand side in FIG. 4. Hence, the cam disks 108 and the springs 107 represent further drive means for the clamping jaws 42*a* and 42*b*.

As will be apparent from the above, during operation, the clamping wheel 21*a* rotates clockwise, in accordance with FIG. 4, so that the clamping jaw 42*a* each time cooperates with the leading end of a clamping shell 87. As a result of the pivotable mounting of the clamping jaw 42*a* on the two-armed lever 92, 93, it is possible for the clamping jaw 42*a* to be pivoted out of the space between the two clamping shells 87 as soon as the space between the two clamping shells 87 has with its leading end passed the saddle 11, and to be pivoted counterclockwise, i.e. opposite to the rotary movement of the clamping wheel 21, to the transfer position which it reaches at the same time as the leading end of the following clamping shell 87 and where it is then pivoted by the cam 101 to its clamping position to grip the back edge of the signature 12 lifted by the lifting comb to the transfer point, as is illustrated in FIG. 5.

The other, i.e. outer side of the clamping wheel 21*a* facing away from the clamping wheel 21*b* will be described in the following with reference to FIG. 5 showing the outer side of clamping wheel 21*b*. It may be imagined that all parts visible, i.e. drawn in unbroken lines in FIG. 5, are illustrated in dotted lines for the other side. This will result in exactly the arrangement of these parts on the clamping wheel 21*a* as seen in the viewing direction of FIG. 4 through the disk 85. Only the letters *b* of the reference numbers used in FIG. 5 must then be replaced by *a*. In addition to the parts already described in connection with the inner side of the clamping wheel 21*a*, this outer side of the clamping wheel 21*b* shows the mounting of two stops 43*b*. Each stop 43*b* is arranged at the radially outer end of a rod-shaped slider 109 which extends more or less in the radial direction and is mounted in a guide element 11 so as to be shiftable in its longitudinal direction. This slider 109 is urged into contact with a roller 112 by the force of a spring, not shown in the drawing, which is arranged in the guide element 111 and urges the slider 109 radially inwards. The roller 112 is carried by the free end of a lever 114 pivotably mounted about a pin 113.

The lever 114 is provided, between the roller 112 and the pin 113, with a roller 115 which rests in contact with a cam disk 116 (FIG. 3) fixed to the bearing housing 35*a*. The guide element 111 is at one side hinged to a pull rod 117 which is guided in an eyelet 118 and whose free end is engaged by a pressure spring 119. The other side of the guide element 111 is pivotably connected to a triangular lever 121 which is pivotably mounted about a pin 122 and carries a roller 123 which also rests in contact with the cam disk 116. Due to the action of pressure spring 119 and the spring (not illustrated) in the guide element 111, the stop 43*b* is held in its inoperative position shown on the right side in FIG. 5 at the leading end of the space between the two clamping shells 87. It is moved from this position by the co-operation of the cam disk 116 with the rollers 115 and 123 to reach the operative position shown on the left-hand side in FIG. 5 at the trailing end of the space between the clamping shells 87. Hence, the cam disks 116 represent drive means for the stops 43*a* and 43*b*.

In a similar manner as described above in connection with the clamping jaws 42*a*, the stops 43*a* and 43*b* having passed the saddle 111 are first moved by the lever 114 radially outwards from the inoperative leading position in the space between the clamping shells 87, shown on the right-hand side in FIG. 5, and then moved by the lever 122 to the operative position, shown on the left-hand side in FIG. 5, at the trailing end of the space between the clamping shells 87, where they arrive exactly at the moment when the lifting comb was lifted the back edge of a signature 12 to the transfer point.

OPERATION

Sprocket wheels 125 and 126 (FIG. 3) which serve as drive means are attached to the ends of the bearing sleeves 34 which project from the bearing housings 35*b* and 39*b* respectively, which housings are secured to the stationary wall 37 of the machine housing. These sprocket wheels are driven by a common drive not shown in the drawing via chains not illustrated either. A special drive for the clamping belts 23*a*, 23*b*, 24*a* and 24*b* (FIG. 1, 2) is not necessary, because these elements are driven through the clamping wheels 21*a*, 21*b*, 22*a* and 22*b* with which they are held in contact.

The cam disk 82 (FIG. 1) moving the two-armed lever 77, 78 for lifting and lowering the lifting comb 17 is also driven by this drive. The connections of these drive means, namely cam disk 82 and sprocket wheels 125 and 126 with the drive, can be adjusted to each other in their phase of motion so that the lifting comb will always lift the back edge of a signature to the transfer point 18 at a speed equal to the peripheral speed of the clamping wheels 21*a*, 21*b*, 22*a* and 22*b* when the one set of stops 43*a* and 43*b* is in its operative position shown in FIG. 7 and when the one set of clamping jaws 42*a* and 42*b* moves out of the release position shown at the left in FIG. 4 to its clamping position and thereby clamps the signature back margin to the clamping wheels 21.

After the apparatus has been adjusted to the height of the signatures fed to the saddle 11, by adjustment of the mounting wall 36, the splined shafts 33 and 38 as well as the axles 41 and 41', the drive of the apparatus is actuated. As a result the signatures fed to the saddle 11 successively in a known manner are lifted by the lifting comb 17 with their back margin to the transfer point 18 so as to abut against the one set of stops 43*a* and 43*b* and are there clamped to the clamping wheels 21*a* and 21*b* by the one set of clamping jaws 42*a* and 42*b* in a position defined in this manner. Since the signature back margin is moved to the transfer point at a speed equal to the peripheral speed of the clamping wheels 21*a* and 21*b*, subsequently no positive or negative acceleration occurs so that each signature lifted to the transfer point is clamped to the clamping wheels 21*a* and 21*b* in a position exactly defined by the one set of stops 43*a* and 43*b*, and is introduced into the clamping gap between the clamping wheels 21 and 22, on the one hand, and the clamping belts 23 and 24 on the other by the rotation of said wheels. This introduction is facilitated in that the stops 43*a* and 43*b* remain in the operative position until a back margin of the signature sufficiently broad to allow gripping of the signature has entered the clamping gap widened by the stops. As soon as this has happened, first the stops 43*a* and 43*b* and then the clamping jaws 42*a* and 42*b* are returned to their rest positions within the clamping shells 87 so that the signature is first only held by the outer clamping elements 21*a*, 23*a* and 21*b*, 23*b*. Owing to the fact that the deflection rollers 25' of the clamping belts 24 are located at a greater radial distance from the axis of the clamping wheels than the deflection rollers 25 of the clamping belts 23, the signature back only enters the inner clamping gaps not widened by stops between the clamping belts 24*a* and 24*b* and the clamping wheels 22*a* and 22*b* respectively, when the signature has already been safely gripped by the outer two clamping gaps so that in this case the accurate position of the signature clamped in the clamping gaps is not impaired either.

When the signature held in the clamping gaps is further rotated, its upper and lower edges are trimmed by the revolving cutter blades 29*a* and 29*b*, the revolving cutter blades 31*a* and 31*b* cutting at the same time a middle strip from the signature so that by means of the illustrated embodiment of the apparatus, two separate signatures are produced from a double signature. Due to the fact that the signature, during the cutting operation, is held directly adjacent to the cutting knife within the entire segment extending over about 90°, in which the clamping elements on either side lie normally side by side to define the clamping gap, a perfect cut is reached. Only after the cutting area has been passed, is the trimmed signature advanced from the clamping gaps to be further transported via the table 30 and by means of the transport device 28.

The inner clamping wheels 22*a* and 22*b* and the inner revolving cutter blades 31*a* and 31*b* provided in the illustrated embodiment are only necessary if a double signature is to be divided into two individual signatures by the central double cut. If this is not required, these parts may be omitted. In the case of signatures of very great height, it may be desired to support the signature approximately in its center in the space between the clamping wheels 21*a* and 21*b* by simple supporting wheels corresponding to the clamping wheels 21*a* and 21*b*.

However, these supporting wheels may also be designed as clamping wheels as in the illustrated embodiment and co-operate with the clamping belts 24*a* and 24*b*, without the revolving cutter blades 31*a* and 31*b* being provided. In the illustrated embodiment, two clamping shells 87 are provided at one clamping wheel 21, these clamping shells being effective for successive signatures. This is advantageous in that it permits an exactly diametrically opposed arrangement of the spaces between the clamping shells and all associated components such as the clamping jaws 42, the stops 43 and the like, with the result that unbalances can be avoided and the spaces can be used as exit openings for the clamping jaws and the stops. This arrangement also results in a larger diameter of the clamping wheels than of the revolving cutter blades whereby the cutter elements 89 are easier to exchange. The length of the clamping shells as measured along the circumference is at least as great as the maximum width of the signatures to be transported by the arrangement so that it can never happen that a signature clamped to one clamping shell overlaps with its trailing edge the clamping jaws 42 and the stops 43 of the next clamping shell.

In a modified embodiment, a single clamping shell with one clamping jaw and one stop instead of two clamping shells may be provided at each clamping wheel. In this case, the clamping surface must be longer than the maximum width of the signature to be advanced. The use of toothed belts as web-shaped clamping elements 23 and 24 has the additional advantage that the teeth of these toothed belts constitute reinforcing ribs preventing the belt from being clamped between the adjacent revolving cutter blade 29 and the cutter element 89 cooperating therewith. However, other endless elongated elements such as belts, steel bands, ropes, chains or the like can also be used as endless elongated clamping elements 23 and 24.

In the illustrated embodiment, the clamping jaws 42 and the stops 43 are movably mounted on the clamping wheel 21. However, they may also be mounted for movement in the machine frame in such a manner that they move together with the circumference of the clamping wheel 21 when in their operative positions.

In FIG. 11, a modified embodiment is illustrated in which, in contrast with the preceding embodiment, the edge of the clamping wheel 21, 22 adjacent to the revolving cutter blade 29, 31 is not constructed as a counter knife 32. For the purpose of illustration, FIG. 11 only shows the clamping wheel **21*a* in connection with the revolving cutter blade 29*a*. In this embodiment, the arrangement shown refers to all cutting devices as formed by the remaining wheel-shaped and belt-shaped clamping elements. According to this embodiment, the circumferential surface of the clamping wheel 21*a* is covered with a cuttable layer 130 made, for instance, of plastics material, and the clamping surface 88 reaches below the revolving cutter blade 29*a* so that said blade cuts into the layer 130. Thus the cuttable layer 130** constitutes a counter knife.

Figure 12:
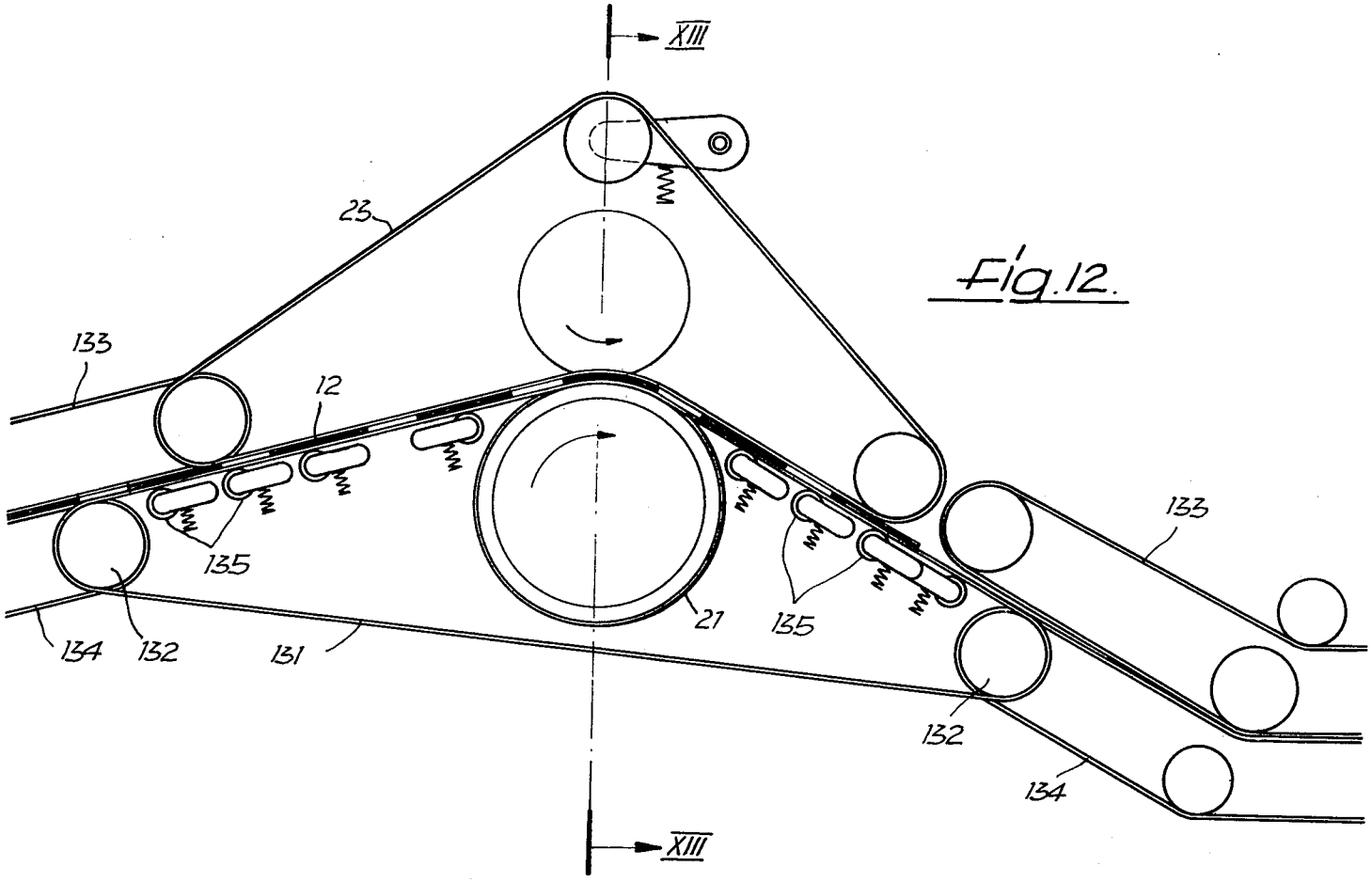
FIG. 12 is a side view of a third embodiment.
Figure 13:
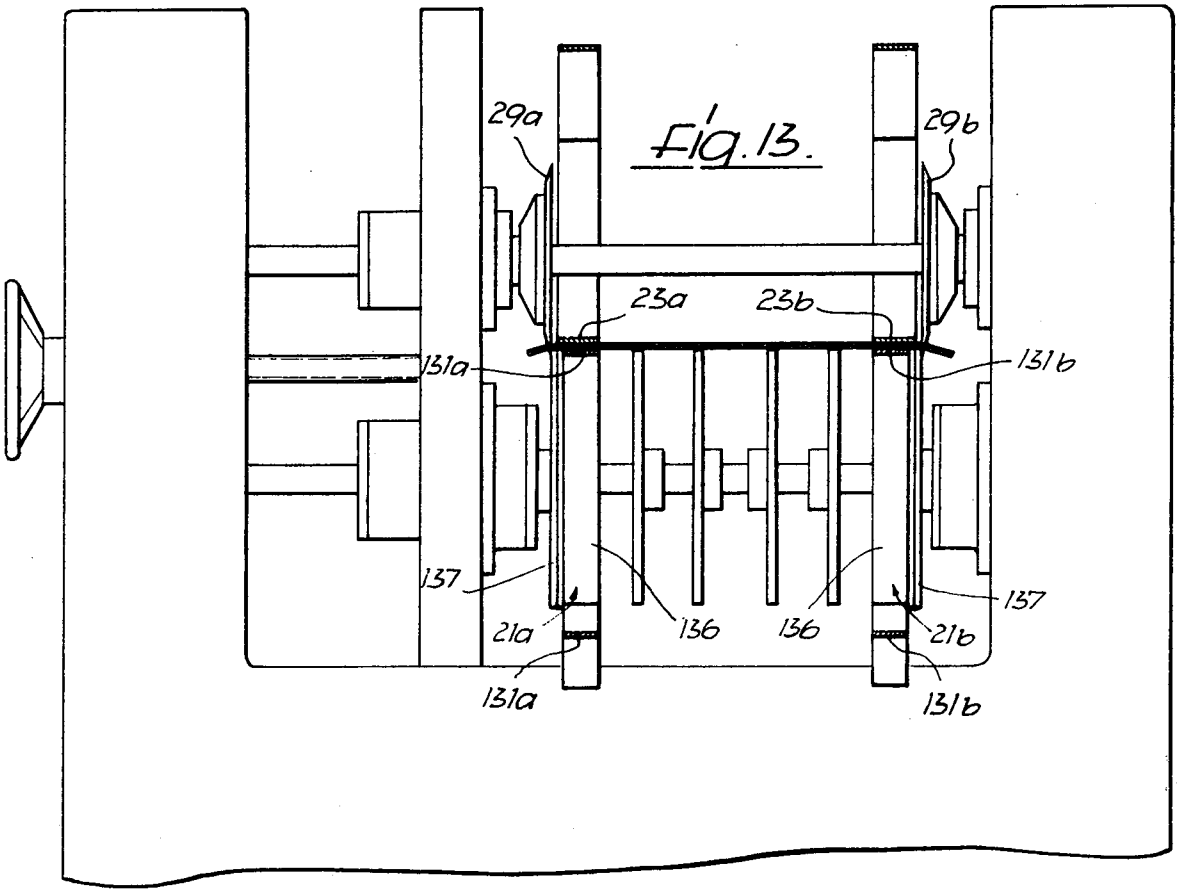
FIG. 13 is a sectional view on line XIII—XIII of FIG. 12.

The embodiment illustrated in FIGS. 12 and 13 differs from the embodiment pursuant to FIGS. 1 – 10 essentially by the fact that between the clamping wheels **21*a* and 21*b* on the one hand and the clamping belts 23*a* and 23*b* on the other hand conveyor belts 131*a* and 131*b* are arranged, which form the first conveyor surfaces and thus, together with the clamping belts 23*a* and 23*b* the conveyor gaps for the signature 12. These conveyor belts 131 are directed about rollers or pulleys 132 such that the straight sections, which are tangent to the clamping wheels 21*a* and 21*b*, protrude from the associated sections of the clamping belts 23*a* and 23*b*, and thereby continue the conveyor gaps for the signature 12 with additional conveying belts 133 and 134. Spring compressed support rollers 135 are provided for supporting the conveying sections of conveyor belts 131**.

The circumferential surfaces of the clamping wheels **21*a* and 21*b* are provided with recesses 136 for the conveyor belts 131*a* and 131*b*, so that rims 137 of the clamping wheels 21*a* and 21*b* protruding above these recesses, form counter knives for the disk-knives 29*a* and 29*b***.

If the conveyor belts **131*a* and 131*b* are constructed as steel strips, then they may themselves form the counter knives for disk-knives 29*a* and 29*b*, so that the recesses 136** are not necessary in that case.

Although the invention has been illustrated and described with reference to the preferred embodiments thereof, it should be understood that it is in no way limited to the details of such embodiments, but is capable of numerous modifications within the scope of the appended claims.

What is claimed is:

1. A device for conveying and cutting a pile of sheets comprising:

a frame;

a conveyor for feeding the pile of sheets in a conveying direction, said conveyor including a first conveyor element having a convex cylindrical circumferential surface and being mounted on said frame for rotation of said cylindrical surface around an axis extending at right angles to said conveying direction and a second conveyor element forming an endless belt having an endless circumferential surface, deflecting means for mounting said endless belt on said frame for revolution along an endless path around an axis of revolution parallel to said axis of rotation, so that a portion of said belt is deflected by a segment of said cylindrical surface of said first conveyor element, first and second endless conveyor surfaces supported by said segment and said portion of said belt, respectively, and defining a clamping gap there-between for clamping the pile of sheets and for conveying the pile of sheets along said gap;

a disk-knife rotatably mounted about an axis parallel to said axis of revolution, said disk-knife having two sides, one of said sides having a rim, said rim being surrounded by a circular cutting edge, at least said rim of said one side and said cutting edge defining a common plane, said plane extending at right angles to said axis of rotation; and first drive means for driving at least one of said conveyor elements and second drive means for rotating said disk-knife;

said first and second conveyor surfaces having edges, said conveyor being arranged so that a portion of said planar rim and said cutting edge overlaps said edges of said first and second conveyor surfaces, said edge of said first conveyor surface being in contact with said cutting edge and said edge of said second conveyor surface being located adjacent said cutting edge, so that said disk-knife and said first conveyor surface constitute a cutting device for cutting a pile of sheets clamped in said clamping gap adjacent to said cutting edge.

2. A device as defined in claim 1, wherein said deflecting means comprises at least three pulleys for guiding said endless belt, said pulleys being arranged such that said first conveyor element lies outside of the area encompassed by said endless belt.

3. A device as defined in claim 2, wherein a toothed belt is provided as said endless belt.

4. A device as defined in claim 2, wherein at least one of said pulleys comprises a spring-loaded idler pulley.

5. A device as defined in claim 1, wherein said first conveyor element is shaped as a body having a circular cylindrical circumferential surface.

6. A device as defined in claim 1, wherein said first conveyor surface is at least partly constituted by said cylindrical surface of said first conveyor element.

7. A device as defined in claim 5, wherein said circular cylindrical surface of said first conveyor element comprises an edge arranged directly adjacent to and overlapping with said cutting edge of said disk-knife, said edge of said first conveyor element constituting a counter knife for co-operation with said disk-knife.

8. A device as defined in claim 1, wherein said first conveyor surface comprises a cuttable layer, said cuttable layer being supported by said cylindrical surface of said first conveyor element so that said cutting edge of said disk-knife overlaps with said first conveyor surface by engagement into said cuttable layer.

9. A device as defined in claim 1, wherein said first conveyor surface includes a second endless belt arranged to be deflected by said cylindrical surface of said first conveyor element.

10. A device as defined in claim 9, wherein a recess is provided for said second belt in said circumferential surface of said first conveyor element and wherein said first conveyor element comprises a rim adjacent said disk-knife, said rim defining said recess and forming a cutting edge for co-operation with said cutting edge of said disk-knife.

11. A device as defined in claim 9, wherein said second endless belt comprises a steel strip.

12. A device as defined in claim 5, wherein at least one pressing means for feeding the pile of sheets into said clamping gap is provided, said pressing means being movably positioned between a release and a clamping position for pressing the leading margin of the pile of sheets to said first conveyor surface for a clamping period, and wherein third drive means is provided for said pressing means, said third drive means being operatively connected to said first drive means.

13. A device as defined in claim 12, wherein each point of said conveyor surfaces defines a plane of revolution, when said conveyor surfaces are revolved, and wherein said clamping gap has a width measured in a transverse direction at right angles to said plane of revolution, said width being smaller than the width of the pile of sheets to be cut measured in said transverse direction, said pressing means being offset from said clamping gap in said transverse direction.

14. A device as defined in claim 13, including stop means protruding radially above said first conveyor surface at said first conveyor element for engaging the leading edge of the pile of sheets.

15. A device as defined in claim 14, wherein said stop means is arranged on said first conveyor element, the path of movement of said stop means caused by the movement of said first conveyor element passing through said clamping gap.

16. A device as defined in claim 15, wherein said stop means is movably mounted for movement between an operative position radially protruding from said first conveyor surface and an inoperative position located beneath said first conveyor surface, and wherein a fourth drive means is provided for moving said stop means, said fourth drive means being operatively connected to said first drive means, so that said stop means is moved from said operative into said inoperative position, only after it has progressed along a predetermined portion of said clamping gap.

17. A device as defined in claim 16, wherein said third and said fourth drive means are operatively connected to each other such that said pressing means is moved into its release position only if said stop means is located in its inoperative position.

18. A device as defined in claim 17, wherein the circumferential length of said circular cylindrical surface is at least as long as the largest dimension of the pile of sheets to be cut measured in said conveying direction.

19. A device as defined in claim 18, wherein said pressing means and said stop means are positioned at said first conveyor element in a space encompassed by its circumferential surface and wherein a recess is provided for said pressing and stop means.

20. A device as defined in claim 19, wherein at least one of said third and fourth drive means includes cam means co-operating with a follower means, said follower means being connected to the means to be moved by said drive means.

21. A device as defined in claim 1, wherein at least two of said cutting devices are arranged parallel to each other, each of which comprises one of said first conveyor elements and one of said disk-knives.

22. A device as defined in claim 21, wherein the first conveyor elements and the associated disk-knives of said at least two cutting devices are positioned each on a common shaft, at least one of said first conveyor elements and at least one of said disk-knives being axially displaceable and lockably supported on said shafts.

23. A device as defined in claim 22, wherein between said two cutting devices two further cutting devices are arranged, each comprising one of said first conveyor elements and an associated disk-knife.

* * * * *